US009550100B2

(12) United States Patent
Grady, Jr.

(10) Patent No.: US 9,550,100 B2
(45) Date of Patent: Jan. 24, 2017

(54) METHOD AND APPARATUS FOR INCREASED SWING VELOCITY, HAND SPEED, AND TIME TO IMPACT WHEN SWINGING WEIGHTED EQUIPMENT

(71) Applicant: Daniel J. Grady, Jr., Weaverville, NC (US)

(72) Inventor: Daniel J. Grady, Jr., Weaverville, NC (US)

( * ) Notice: Subject to any disclaimer, the term of this patent is extended or adjusted under 35 U.S.C. 154(b) by 0 days.

(21) Appl. No.: 14/961,434

(22) Filed: Dec. 7, 2015

(65) Prior Publication Data

US 2016/0166901 A1 Jun. 16, 2016

Related U.S. Application Data

(60) Provisional application No. 62/124,260, filed on Dec. 15, 2014.

(51) Int. Cl.

| | |
|---|---|
| ***A63B 59/06*** | (2006.01) |
| ***A63B 69/36*** | (2006.01) |
| *A63B 69/38* | (2006.01) |
| *A63B 69/00* | (2006.01) |
| *A63B 71/06* | (2006.01) |

(52) U.S. Cl.

CPC ..... *A63B 60/06* (2015.10); *A63B 60/50* (2015.10); *A63B 59/50* (2015.10); *A63B 60/12* (2015.10); *A63B 60/16* (2015.10); *A63B 60/24* (2015.10); *A63B 69/3632* (2013.01); *A63B 69/38* (2013.01); *A63B 2069/0008* (2013.01); *A63B 2071/0694* (2013.01); *A63B 2210/50* (2013.01); *A63B 2225/01* (2013.01)

(58) Field of Classification Search

USPC ..... 473/206, 457, 568

See application file for complete search history.

(56) References Cited

U.S. PATENT DOCUMENTS

| | | | | |
|---|---|---|---|---|
| 2,780,464 A | | 2/1957 | Ashley | |
| 3,084,938 A | | 4/1963 | Kapanowski | |
| 3,203,697 A | * | 8/1965 | Berzatzy | A63B 49/08 16/430 |
| 3,469,839 A | | 9/1969 | Pietronuto et al. | |
| 4,709,925 A | * | 12/1987 | Gatlin | A63B 69/38 473/463 |
| 5,011,145 A | | 4/1991 | Bartkowicz | |

(Continued)

OTHER PUBLICATIONS

"Markwort Knobcuft® EZ Taper". 1 page. 2013 Markwort Baseball Softball Catalog. Accessed online Dec. 7, 2015 at http://www.markwort.com/pdfs/2013B/b94.pdf. Markwort, St. Louis, MO.

*Primary Examiner* — Nini Legesse

(74) *Attorney, Agent, or Firm* — Coats & Bennett, P.L.L.C.

(57) ABSTRACT

A method and apparatus to improve swing velocity, hand speed, and time to impact when swinging weighted, club-like equipment such as sporting equipment and tools. The method and apparatus include an enlarged flange positioned on the handle of the equipment. The flange includes a greater size than the handle to contact against the user's hand. The apparatus may be manufactured on new equipment, or added to existing equipment. The device and methods also improve safety by preventing hand injury during a swing, and prevent accidental release of the equipment during a swing.

19 Claims, 7 Drawing Sheets

(56) References Cited

U.S. PATENT DOCUMENTS

| | | | | | |
|---|---|---|---|---|---|
| 5,163,685 | A * | 11/1992 | Rhodes | A63B 53/14 | 473/206 |
| 5,215,307 | A | 6/1993 | Huffman | | |
| 5,238,246 | A | 8/1993 | Erb | | |
| 5,259,610 | A | 11/1993 | Erb | | |
| 5,624,114 | A | 4/1997 | Kelsey | | |
| 6,059,675 | A * | 5/2000 | Finn | A63B 59/50 | 473/457 |
| 6,234,924 | B1 | 5/2001 | Washburn, Jr. | | |
| 6,482,113 | B1 | 11/2002 | Finn | | |
| 7,125,353 | B2 | 10/2006 | Blount | | |
| 7,169,069 | B1 | 1/2007 | Dalton et al. | | |
| 7,201,683 | B2 | 4/2007 | Estape et al. | | |
| 7,261,639 | B2 * | 8/2007 | Smith | A63B 53/14 | 473/206 |
| 7,435,196 | B2 | 10/2008 | Darmohusodo et al. | | |
| 7,931,541 | B2 * | 4/2011 | Rhodes | A63B 69/3632 | 473/201 |
| 8,128,542 | B2 | 3/2012 | Hartman et al. | | |
| 8,944,943 | B2 | 2/2015 | Heiberg | | |
| 2001/0031674 | A1 * | 10/2001 | McGinnis | A63B 69/0002 | 473/451 |
| 2009/0054171 | A1 | 2/2009 | Lee | | |
| 2009/0170621 | A1 | 7/2009 | Evans | | |
| 2013/0196800 | A1 * | 8/2013 | Boatwright | A63B 59/0044 | 473/568 |

* cited by examiner

METHOD AND APPARATUS FOR INCREASED SWING VELOCITY, HAND SPEED, AND TIME TO IMPACT WHEN SWINGING WEIGHTED EQUIPMENT

RELATED APPLICATIONS

This application claims the benefit of U.S. Provisional Application No. 62/124,260 filed Dec. 15, 2014, which is hereby incorporated by reference in its entirety.

BACKGROUND

Many types of equipment such as but not limited to baseball bats, softball bats, golf clubs, tennis racquets, hammers, pickaxes, and sledgehammer generally include a handle which is gripped by the hands at the proximal end, and a weighted object at the distal end of the handle. The weighted object may be incorporated into the handle (e.g., a barrel of a baseball bat that is integrally formed with the baseball bat handle) or may be a separate element attached to the handle (e.g., head of a hammer that is attached to a handle). The act of swinging weighted, club-like equipment in a circular or elliptical trajectory generates several dynamic forces.

More specifically, turning forces result because a spinning object such as a baseball bat swung in a circular or elliptical trajectory has angular momentum and resists a change in direction. Also, during the swing centrifugal force is created such as when the barrel of the baseball bat or golf club is pulled away from the body and centripetal force is generated to pull the weighted object proximal to the body. Because of these forces it is necessary for the user to tightly grip the handle with their hands to hold on to the equipment.

A tight hand grip can result in multiple negative consequences. For example, one negative consequence of tight hand grip during a swing is the generation of friction between the skin of the hands and the handle. Friction results from the force of the weighted equipment which pull the equipment away from the body, and the force created when the bat handle moves due to opposing forces to pull the handle towards the body. Therefore, the user tightens the hand grip to hold on to the handle which prevents the forces from causing the equipment to fly out of their hands.

Another negative consequence of tight hand grip during a swing is injury to the hands. Friction from repetitive swings using known, traditional equipment can result in skin blisters. Further, tight hand grip during a swing may result in injury to the user's hand bones. Specifically, bruising and fracture of the tricumvarate, pisiform, and hamate bones in the hand results from pressure generated against a narrow surface area of the hand in contact with the swinging equipment. Also, damage to the ulnar nerve in the hand may occur when the forces generated during a swing of weighted equipment are transmitted to a narrow surface area on the hand. This damage may result in loss of grip during a swing and the equipment being thrown from the hand.

A third negative consequence of tightened hand grip is decreased swing velocity. Tight hand grip promotes slower swing speed because of large muscle contraction. Slower swing speed decreases impact and results in less force for hitting an object, such as a baseball, nail, or a golf ball. Tight hand grip can also produce less precision due to the aforementioned loss of fine motor muscle use in the hands.

SUMMARY

The present application is directed to devices and methods for an enlarged grip for use on a handle of equipment. The grip may include an aerodynamic structure that reduces resistance to airflow during a swing. The grip includes an increased surface area that forms a contact area for the user's hand to redistribute forces to minimize hand injury. Further, the redistribution of forces to an increased surface area allows the hands to relax during a swing, and fine motor muscles may be utilized to improve swing precision during impact. The device and method improve the swing velocity, hand speed, time to impact, and precision of equipment by capturing and redirecting turning, centripetal, and centrifugal forces to the user's advantage.

The device provides an increased surface area to contact with the user's hand which redistributes turning forces, allows the hands to relax during a swing, thereby utilizing fine motor control of the hands to improve hand speed, swing velocity, hitting precision, and time to impact.

The increased surface area in contact with the hands improves safety to the user by reducing friction which can cause blisters. Further, the increased surface area for hand contact redistributes pressure on the hand to a greater area, thereby reducing hand injury associated with bone compression, bruising, and fracture as well as ulnar nerve injury. The increased surface area may also reduce injury by decreasing the incidence of the equipment accidently flying out of the user's hand during a swing. The device may also include an aerodynamic structure that reduces resistance to air during the swing, thereby improving swing velocity and hand speed.

The device may also be lightweight and may counterbalance the weight at the distal end of equipment, thereby improving the swing trajectory, time to impact, and precision.

The device may be manufactured on new equipment, or the apparatus added to existing equipment.

One embodiment is directed to a method of using a flange device with equipment to improve a user's swing of the equipment. The method includes grasping a handle of the equipment between the flange device and a distal end of the handle. The flange device is attached to the handle and extends completely around the handle with a perimeter wall of the flange device being radially spaced outward from the handle and with a first side of the flange device facing towards the distal end of the handle and an opposing second side facing in an opposing direction. The method also includes contacting the first side of the flange device while grasping the handle. The method includes aligning an indent in the flange device with an injury-prone section of the user's lower hand. The indent extends into the first side and the perimeter wall and is positioned at an intersection of the first side and the perimeter wall, and the injury-prone section comprising triquetral and pisiform bones region. The method also includes swinging the equipment while grasping the handle and maintaining contact with the first side and of the flange device and with the injury-prone section remaining aligned with the indent.

The method may also include that first side of the flange device comprises a cushion layer and contacting the first side of the flange device includes contacting the cushion layer.

The method may include swinging the equipment and forcing air to travel through holes in the flange device that extend between the first and second sides with the holes being spaced around the periphery of the flange device and being closer to the perimeter wall than to a center of the flanged device. The method may also include moving the air through a section of the holes that has a reduced cross-sectional area and that is positioned along a length of the holes in proximity to the first side of the flange device.

The method may include sliding the handle through a central opening in the flange device and adjusting a position of the flange device along the handle of the equipment. The method may include contacting the second side of the flange device against an enlarged knob at a proximal end of the handle with the enlarged knob having a length that is less than the flange device and greater than the handle with the lengths measured in a plane perpendicular to a midline of the handle.

The method may include removing the flange body from the handle by pivoting apart first and second sections of the flange body that are connected together at a pivot. The method may also include attaching the flange body to the handle of the equipment by positioning ends of each of the first and second sections into an overlapping arrangement.

Another embodiment is directed to a method of using a flange device with equipment to improve a user's swing of the equipment. The method includes grasping a handle of the equipment and contacting a top side of the flange device that is attached to the handle. The flange device extends circumferentially around the handle with a bottom side of the flange that opposes the top side contacting against a knob at a proximal end of the handle of the equipment. The flange device includes a greater length than the handle and the knob with the length measured across the flange device in a plane perpendicular to a midline of the handle. The method includes swinging the equipment while grasping the handle and maintaining contact with the first side and of the flange device.

The method may include aligning an indent positioned within the top side of the flange device with the hamate bone of the user.

The method may include contacting the top side of the flange device continuously around the circumference of the handle.

The method may include that the top side of the flange device includes a cushion layer and contacting the first side of the flange device includes contacting the cushion layer.

The method may include swinging the equipment and forcing air to travel through holes that extend through the flange device.

The method may include sliding the handle through a central opening in the flange device and adjusting a position of the flange device along the handle of the equipment.

The method may include moving a rounded projection on a proximal end of the handle with the equipment with the rounded projection including a first side that faces the handle that is flat and a second side that includes a rounded shape.

Another embodiment is directed to a device for positioning along a handle of a piece of swinging equipment with the equipment including a first end with the handle and a second working end. The device includes a body with a contact side configured to be positioned towards the second working end, an opposing second side, and a perimeter wall that extends between the first and second sides with the body including a central opening sized to receive the handle and extending completely around the central opening and the body having a length that is greater than the handle. The device also includes that the contact side of the body being flat, and an indent is positioned at an intersection of the first side and the perimeter wall and that extends into the first side and the perimeter wall.

The device may also include that the second side of the body is flat and the body includes a constant thickness measured between the contact side and the second side.

The device may also include holes that extend through the body with openings at each of the second side and the contact side with the holes being spaced apart around the periphery of the body and being closer to the perimeter wall than to the central opening.

The device may include that the body is a constructed as a single piece.

The device may include that the body is constructed from first and second sections that are connected together at a pivot and that each of the first and second sections includes a first end in proximity to the pivot and an opposing second end with the body being movable between an open orientation with the second ends being spaced apart and a closed orientation with the second ends that enclose the central opening.

The various aspects of the various embodiments may be used alone or in any combination, as is desired.

DETAILED DESCRIPTION

The present application is directed to a device for positioning along a handle of equipment to assist in swinging the equipment. The device is configured to be attached to the equipment at a desired location along the handle. The device includes a body with an enlarged contact surface that is aligned with the handle. The contact surface includes an enlarged area configured to be contacted by a user while swinging the equipment.

One application uses the device with a bat, such as that used for baseball or softball. The device is also applicable for use with other equipment, including but not limited to other sporting equipment such as golf clubs and tennis racquets, as well as work equipment such as hammers, pickaxes, and sledgehammer. For purposes of discussion, the present application will use the embodiment of a baseball bat in describing the device. It is understood that this is just one embodiment of the broader application of the device.

Figure 1:
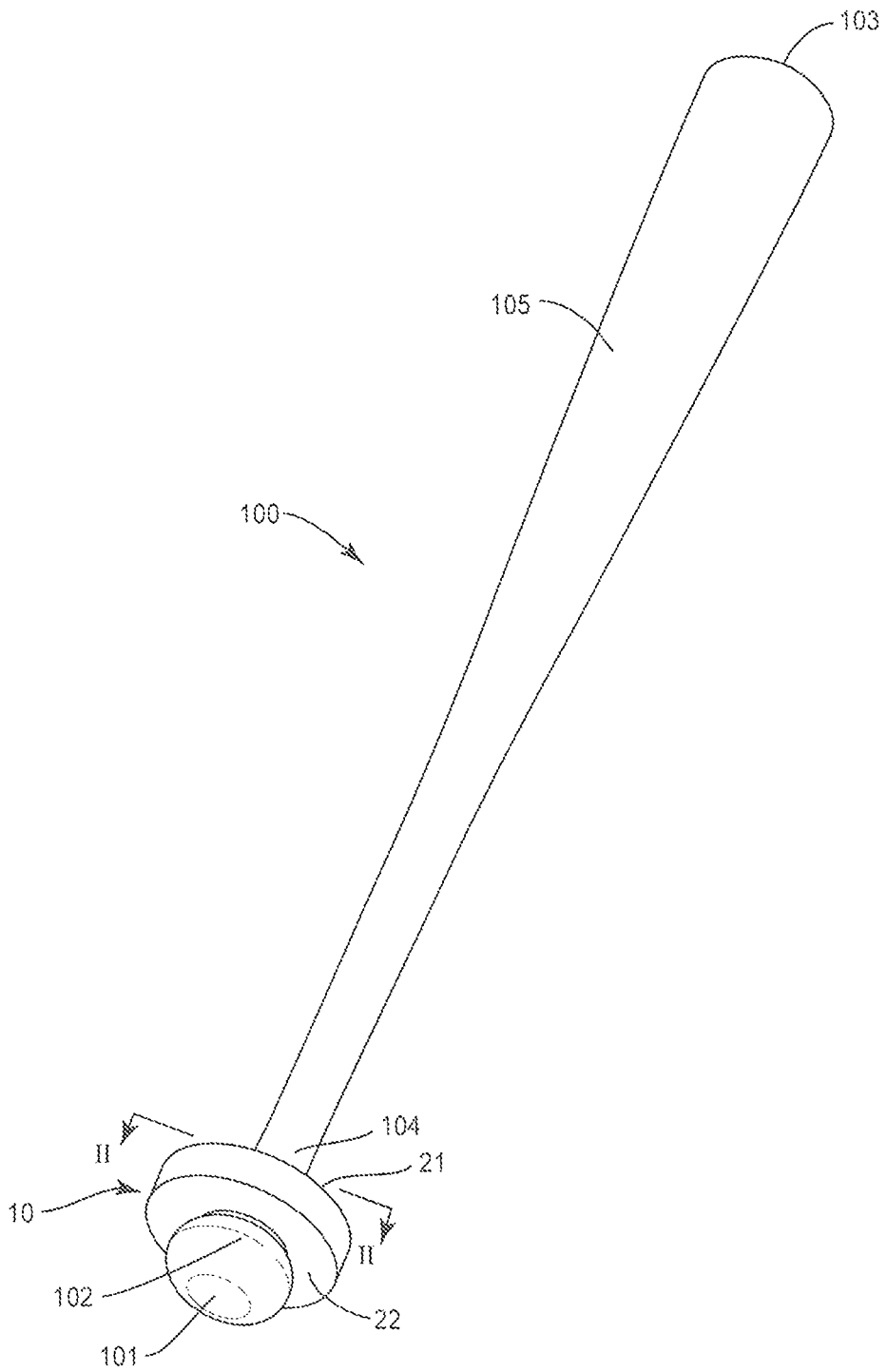
FIG. 1 is a perspective view of a device on a bat.

FIG. 1 illustrates one embodiment with the device 10 attached to a baseball bat 100. The baseball bat 100 includes a proximal end 101 with a knob 102 and a distal end 103.

The bat 100 includes a handle 104 in proximity to the knob 102 and is sized to be grasped by the user. The handle 104 includes a distal end (towards the bat head 105) and a proximal end at the knob 102. The knob 102 includes a larger diameter than the handle 104. The bat 100 also includes the barrel or head 105 in proximity to the distal end 103 for hitting a ball.

The device 10 is positioned along the handle 104 towards the proximal end of the handle. FIG. 1 includes the device 10 positioned along the handle 104 in contact against the knob 102. The device 10 may also be positioned along the handle 104 at various locations away from the knob 102.

Figure 2:
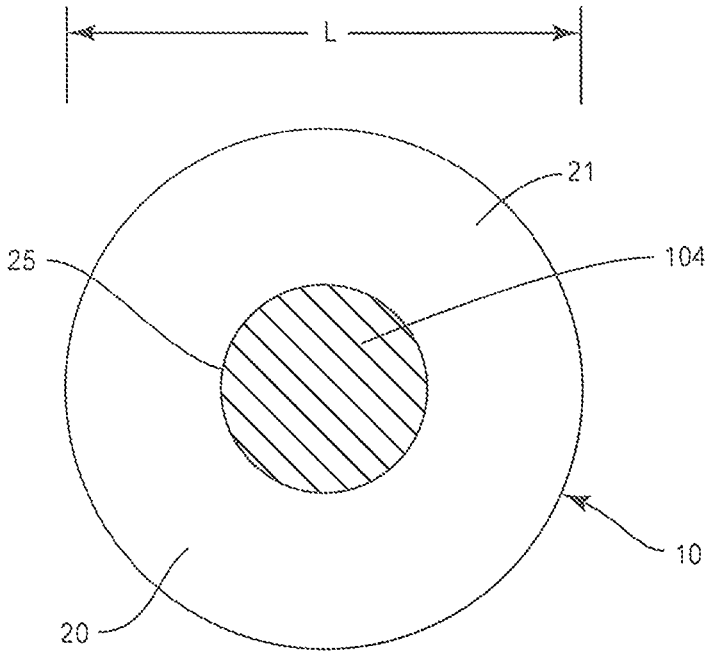
FIG. 2 is a sectional view taken along line H-H of FIG. 1.

The device 10 may be a separate element that is attached to the bat 100. The device 10 may also be integral with and manufactured as part of the bat 100. FIGS. 1 and 2 include the device 10 constructed as a separate element than the bat 100. The device 10 includes an annular body 20 with a central opening 25 that is sized to receive the handle 104. The central opening 25 may be shaped to match the sectional size and shape of the handle 104. Alternatively, the central opening 25 may include a different size and/or shape. The embodiment illustrated in FIG. 2 includes both the central opening 25 and handle 104 with circular sectional shapes. The central opening 104 is sized relative to the handle 104 to maintain the device 10 on the handle 104.

The body 20 includes a contact side 21 that faces towards the distal end 103 and an opposing second side 22. A perimeter wall 23 extends between the two sides 21, 22. The perimeter wall 23 may be flat, may include an outward curve, or may include an inward curve.

The sectional shape of the body 20 may vary, with one embodiment including a circular shape. The body 20 may also include other sectional shapes, including but not limited to oval, oblong, rectangular, and polygonal. The length L of the device 10 is measured between opposing sides. The length L is larger than the length of the knob 102 thereby creating a larger surface area for contact by user's hand when swinging the equipment. When the device 10 is used in particular contexts, the size of the device 10 may be limited by the rules of the game and conform to the league requirements. Several established size requirements include the following:

Professional Major League Baseball: 2.75 inches.

NCAA College and High School: 2.75 inches (wood bat); 2.625 (composite/metal bat)

Senior League: 2.625 inches

Little League: 2.25 inches

Figure 3:
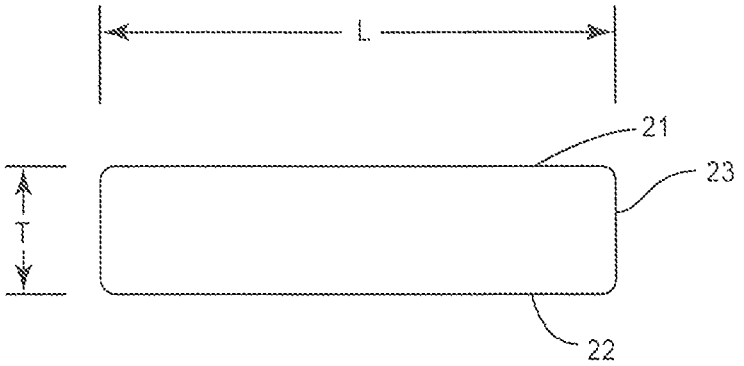
FIG. 3 is a side view of a device.

As illustrated in FIG. 3, the contact side 21 and the opposing side 22 may each be substantially flat. This results in the device 10 having a constant thickness T measured between the sides 21, 22. Other embodiments may include one or both sides 21, 22 having different shapes and configurations. Further, the thickness of the body 20 may vary across the length L.

Figure 4:
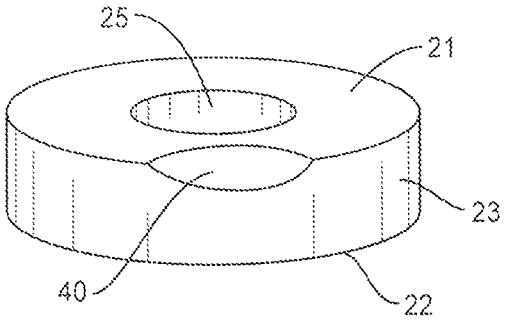
FIG. 4 is a perspective view of a device that includes an indent.

An indent 40 as illustrated in FIG. 4 may be formed in the contact side 21 of the body 20 to receive a portion of the user's hand, particularly the lateral bones of the lower hand (the pisiform and triquetrum bones). The indent 40 may further extend into the perimeter 23. In one embodiment, the indent 40 is positioned at the intersection of the first side 21 and the perimeter wall 23 and extends into both. The size and shape of the indent 40 may vary depending upon the user. In some embodiments, the indent includes a horizontal length that is between 1.5-3.0 inches, a depth measured from the contact side 21 of between 0.5-0.7 inches, and extends from the perimeter 23 radially inward between 1.0-1.25 inches. The bilateral edges of the indent 40 smoothly slope downward towards a bottom of the groove at an angle of between 10°-20°. The device 10 may include a single indent 40, or may include two or more indents 40.

Figure 5:
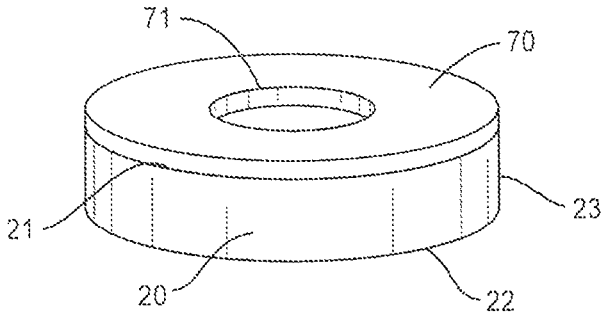
FIG. 5 is a perspective view of a device that includes a cushion layer.

A cushion 70 may be positioned on the contact side 21 of the body 20 as illustrated in FIG. 5. The cushion 70 is deformable to further protect the user's hand. The cushion 70 includes a central opening 71 that aligns with the opening 25 of the body 20 to receive the handle 104. The thickness of the cushion 70 may be the same or vary along the contact side 21 of the body 20. FIG. 5 includes the thickness being the same across the contact side 21. The cushion 70 may be constructed as a single piece, or may include two or more separate pieces. The cushion 70 may be fixed to the body 20 in a variety of manners, including but not limited to adhesives and mechanical fasteners. The cushion 70 may be constructed from different materials including foam and other shock-absorbing materials. One specific cushion includes LIZARD SKINS bat wrap. The cushion 70 may be formed by a single layer, or may include two or more layers. In embodiments with an indent 40, the cushion 70 may be spaced away from the indent 40. Alternatively, the cushion 70 may extend along and be attached to the indent 40.

Figure 6:
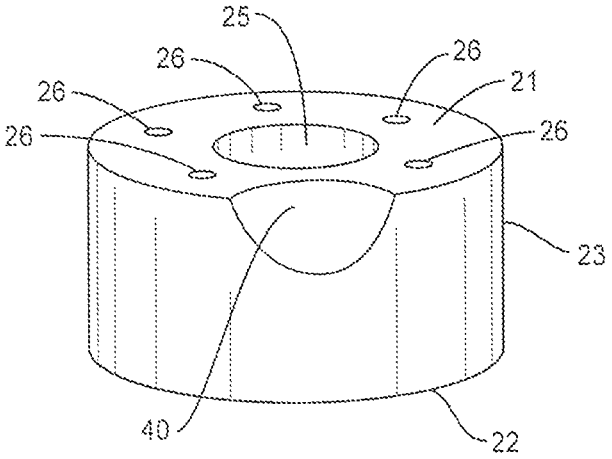
FIG. 6 is a perspective view of a device that includes holes and an indent.

As illustrated in FIG. 6, the body 20 may further includes holes 26 that extend the thickness measured between the contact side 21 and opposing side 22. The holes 26 provide for airflow through the body 20 when the device 10 is swung with the equipment. The holes 26 increase the aerodynamics of the device 10 and increase the swing speed. The holes 26 may be positioned in proximity to the perimeter 23 such that they are not blocked by the knob 102 when the device 10 is positioned on the bat 100.

Figure 7:
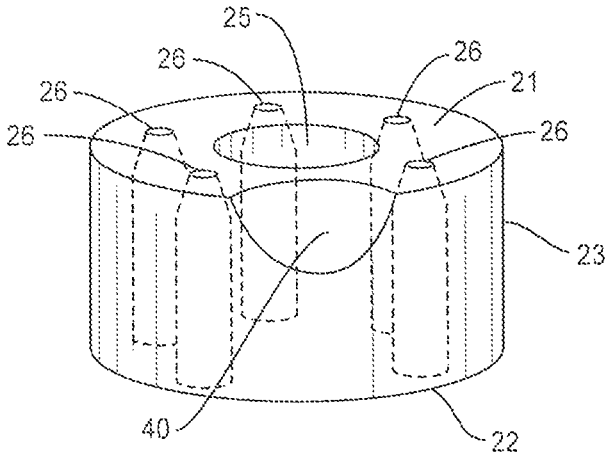
FIG. 7 is a perspective view of a device with hidden lines that illustrate the holes that extend through the device.

The holes 26 may include a constant size along the thickness of the body 20. Alternatively, the thickness may vary. FIG. 7 includes the holes 26 having a smaller size at the contact side 21 and a larger size at the opposing side 22. In one embodiment, the holes 26 include a size of 1.0-1.5 mm at the contact side 21 and 3.0 mm at the opposing side 22. The different holes 26 may include the same or different shapes and/or sizes.

In use, when the equipment is being swung by the user, air enters into the holes through the opposing side 22. The air moves along the holes 26 and exits at the contact side 21.

Figure 8:
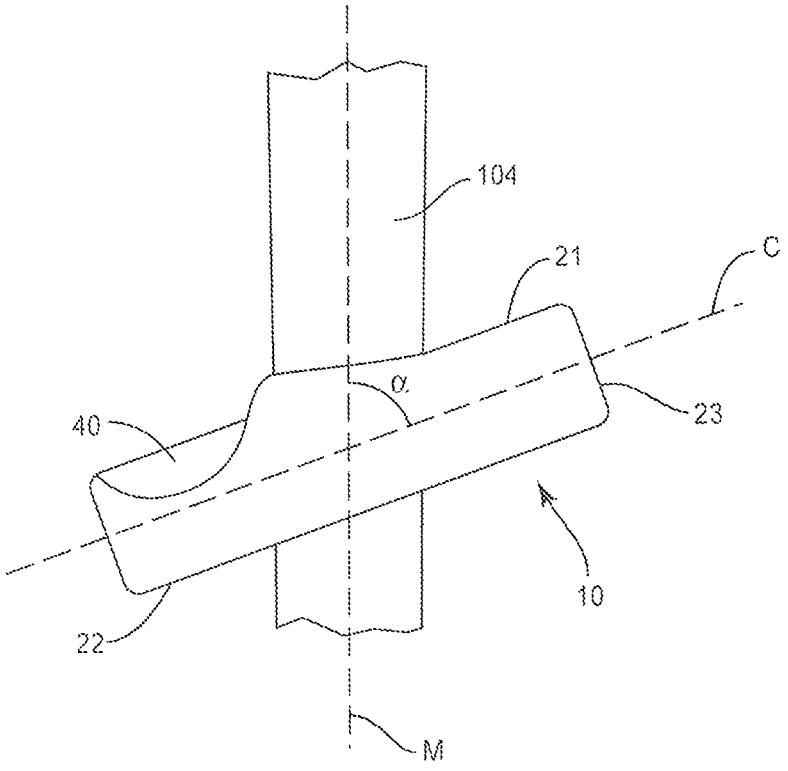
FIG. 8 is a schematic side view of a device attached to an equipment handle with the device aligned at a non-perpendicular angle relative to the handle.

The device 10 may be arranged at a variety of different angles relative to the bat 100. The device 10 includes a midline C measured across the length and through the perimeter walls 23. The bat 100 further includes a midline M that extends through the handle 104. The device 10 may be configured with the midline C arranged at different angles $\alpha$ relative to the midline M. The device 10 may be arranged perpendicular to the handle 104 such that the angle $\alpha$ is 90°. FIG. 8 includes the angle $\alpha$ being non-perpendicular. In one non-perpendicular embodiment, the angle $\alpha$ is between 10°-30°.

The body 20 of the device 10 may include a variety of different structures. In one embodiment as illustrated in FIG. 2, the body 20 is constructed as an integral, one-piece construction.

Figure 9:
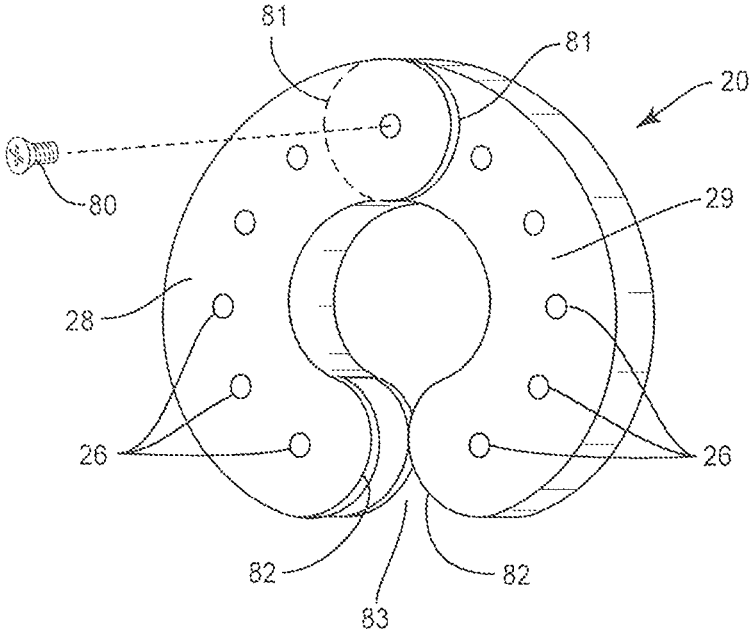
FIG. 9 is a perspective view of an adjustable device in an open orientation.
Figure 10:
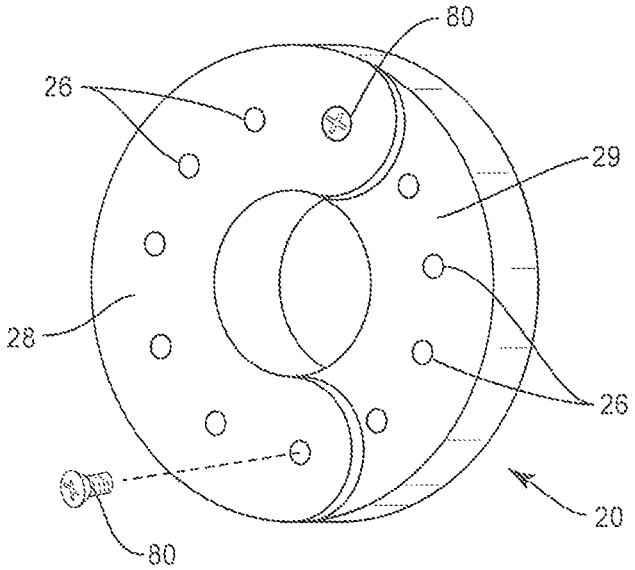
FIG. 10 is a perspective view of an adjustable device in a closed orientation.

The body 20 may also be constructed from two or more different pieces that are attached together. FIG. 9 includes a body 20 constructed from first and second sections 28, 29. The different sections 28, 29 are configured to be connected together to form the body 20. One or more sections 28, 29 include receptacles configured to receive one or more fasteners 80 to connect the sections 28, 29 together. The sections 28, 29 are placed in an overlapping arrangement and held together with the fastener(s) 80. The sections 28, 29 may have the same or different shapes and/or sizes. FIGS. 9 and 10 include each of the sections 28, 29 having the same size and shape.

As illustrated in FIG. 9, each of the sections 28, 29 includes a first end 81 and a second end 82. The first ends 81 may be attached together with the sections 28, 29 being pivotal relative to each other. The body 20 may be selectively positioned between an open position and a closed position. In the open position, the second ends 82 are spaced apart by a gap 83. The gap 83 is sized to receive the handle 104 for positioning the body 20 on the handle 104. Once the sections 28, 29 are placed around the handle 104, the sections 28, 29 are pivoted to the closed position such as that illustrated in FIG. 10. In the closed position, the central opening 25 is completely enclosed. The second ends 82 may be abutted together, or may be aligned in an overlapping arrangement as illustrated in FIG. 10. Receptacle at each of the ends 82 may be aligned to receive a fastener 80 to secure the body 20 in the closed orientation.

In the various embodiments, the body 20 may be constructed from the same or different materials than the handle 104.

Figure 11:
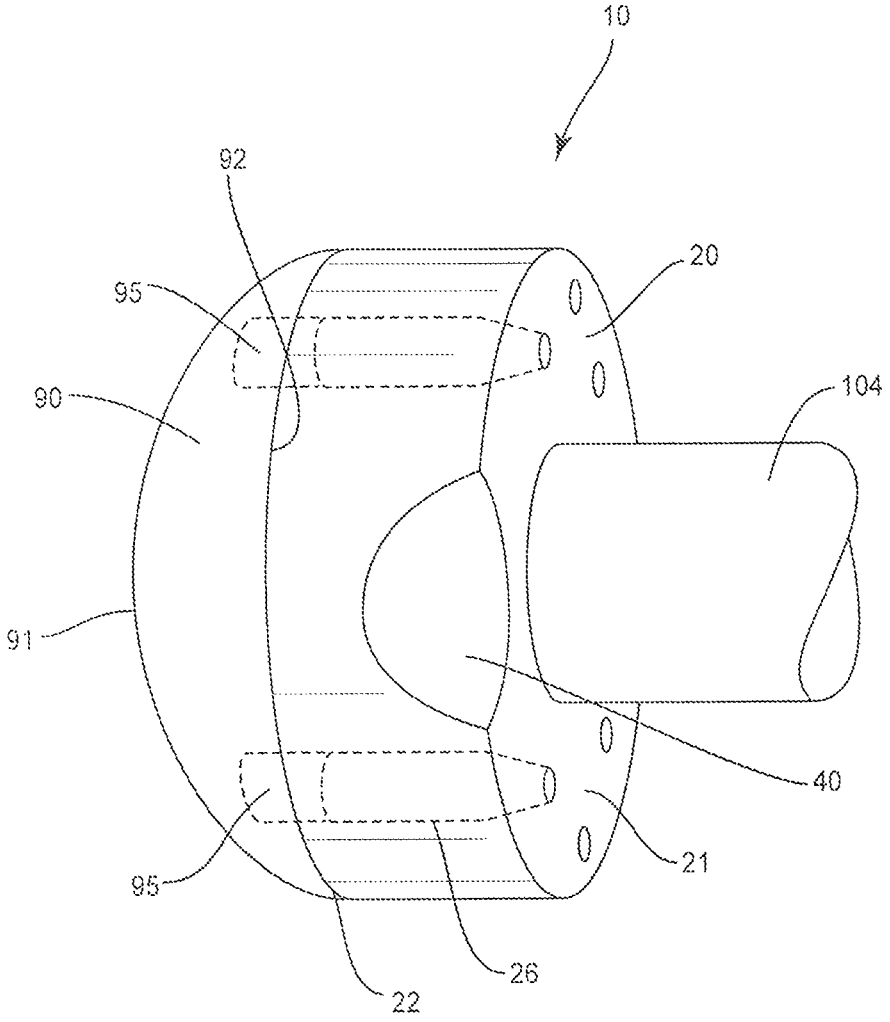
FIG. 11 is a perspective view of a projection attached to a second side of a device.

An aerodynamic projection 90 may be connected at the proximal end 101 of the bat 100 as illustrated in FIG. 11. The projection 90 includes a rounded end 91 that is exposed that creates streamlined airflow around the knob 102 thereby decreasing air resistance and improving bat speed, hand speed and time to impact.

The projection 90 includes the rounded end 91 and an opposing end 92. The opposing end 92 may be positioned in contact with the opposing side 22 of the body 20 or may be in contact with the proximal end 101 of the bat 100. In one embodiment, the opposing side 22 is mounted on the exposed end of the knob 102. The bullet-shaped projection 16 covers the flat surface at the bottom of the knob 102 that would otherwise create air resistance when the knob 102 is pulled towards a ball early in the swing. The projection 90 may include a smaller or equal length relative to the body 20 to further facilitate the aerodynamics. The projection 90 may be mounted to the handle 104 and/or body 20 in various manners, including but not limited to adhesives and mechanical fasteners.

As illustrated in FIG. 11, the projection 90 may include holes 95 that align with the holes 26 in the body 20 when the projection 90 is mounted on the device 10. Thus, air flow created during the swing moves through both the projection and the body 20.

The body 20 of the device 10 may be attached to the equipment 100 in a variety of different manners. In one embodiment, the body 20 is formed with the handle 104. Thus, the body 20 and handle 104 include an integral, one-piece construction. In another embodiment, the body 20 is slid onto the proximal end 101 of the handle and slid along the handle 104 to the desired location. The body 20 may be attached to the handle 104 at this position, such as but not limited to mechanical fasteners, adhesives, tape, a rubber inner layer, and magnets/electromagnets.

Figure 12:
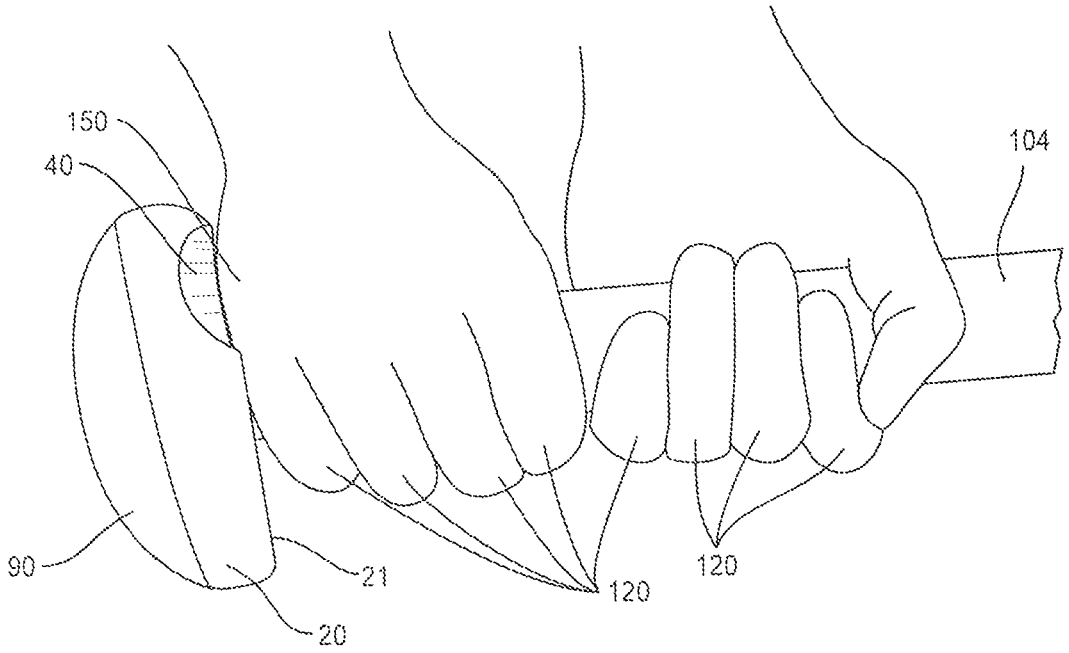
FIG. 12 is a side view of a user gripping an equipment handle that includes a device.

The device 10 facilitates the use of a bat by a user. As illustrated in FIG. 12, the bat handle 104 is gripped primarily by the fingers and portions of the hand such that the "knocking knuckles" 120 of the hand are in proper alignment. The lateral bones 150 of the lower hand (triquetral and pisiform bones region) rest within the indent 40 and the lateral portion of the lower hand rests against the enlarged body 20, or upon the cushion 70 on the body 20.

FIG. 12 illustrates a user grasping the handle 104 with two hands and with the lower side of the second hand contacting against the device 10. The device 10 may also be used when a user grips the handle 104 with a single hand. This may be application in various contexts, including but not limited to tools such as hammers and drills.

The enlarged surface of the body 20, which exceeds the outer diameter of the lateral portion of the user's lower hand, results in very significant and beneficial effects when compared to traditional bats during a swing. First, the hands remain relaxed since the lower hand rests against the outer surface of the enlarged body 20. During a swing, as the body 20 is pulled towards the pitched ball, a "whip" type of action is created with the barrel of the bat 100. During the swing, centrifugal and centripetal forces are directed towards the enlarged surface area of the body 20 that is in contact with the hand. Further, the aerodynamic projection 90 at the proximal end of the handle 104 creates a smooth, aerodynamic air stream around the body 20 which facilitates faster bat speed, hand speed, and decreased time to impact.

Also, the optional presence of holes 26 within the body (not illustrated in FIG. 12) allow air flow through the body 20 which further decreases air resistance and improves bat and hand speed. The presence of holes 26 within the body 20 causes airflow into the inlets of the holes that face away from the user's hands. In some embodiments, the air moving through the holes 26 encounter a restricted orifice at the nozzle or outflow orifice resulting in increased velocity and decreased lateral air pressure downstream from the outflow aperture, per Bernoulli's theorem.

Since the enlarged body 20 redirects forces during a swing (as compared to a traditional bat), the device 10 improves safety since the lateral hand bones of the user's lower hand move within the indent 40. The forces thus generated are directed to a wider surface area on the lateral surface of the lower hand, as opposed to the narrow surface area with traditional bats. Per the formula for pressure (defined as force per unit area), an inverse relationship exists between surface area and pressure. That is, as surface area increases, pressure decreases, as is the case with the device 10.

During the swing, the turning forces generated by the bat head and angular momentum create a force which pulls the bat head away from the user's body. This force is transmitted to the user's hands with one of the hands resting against and remaining in contact with the body 20 during the swing. The body 20 refocuses centrifugal force which allows the hands to remain relaxed. Relaxed hands during a swing result in an increased bat velocity and provide greater precision by allowing fine muscle motor control in the hands to direct the swing. Greater bat speed velocity and precision during a swing produce higher impact and greater distance when striking a ball.

Tests were conducted comparing a bat with the device 20 against a traditional baseball bat. These tests confirmed the improved physical capabilities of the device 20.

Test

Methods: Five college/varsity high school baseball players volunteered to compare hitting results using a traditional bat with a bat that includes the device described above.

Bat 1:
- Length: 32 inches
- Weight: 29 ounces
- Style: Axis model Ek-tech AX271 from Axis Bats, Fall River, Mass.

Grady Bat:
- Length: 32 inches
- Weight: 30 ounces
- Device: positioned along the handle and in contact with the knob at the proximal end of bat.

Model: Axis AX 271 from Axis Bats, Fall River, Mass.

Testing Equipment:

Zepp software sensor from Zepp Labs (www.Zepp.com). The Zepp software sensor was calibrated prior to use per manufacturer instructions.

Testing Criteria:

Zepp Challenge Protocol was used to standardize testing. This Protocol included a baseball being placed on a hitting tee with the ball placed at approximately 40% of the height of the hitter and the tee is located perpendicular to the hitter's front foot.

Each hitter used Bat 1 for 3 swings and the Grady Bat for 3 swings of recorded data. A total of 15 swings (n=15) were made using each of Bat 1 and the Grady Bat.

Detected measurements: bat velocity, hand speed, time to impact Descriptive statistics (mean, variance, and standard deviation) were calculated for all measurements in both groups using an Excel statistics program. Percent improvement was also calculated for comparison of both groups.

| Time to Impact (Seconds) | | | |
|---|---|---|---|
| Bat 1 | Grady Bat | Difference | Percent Improvement |
| 0.12 | 0.11 | 0.01 | 8.3 |
| 0.122 | 0.114 | 0.008 | 6.6 |
| 0.158 | 0.118 | 0.04 | 8.7 |
| 0.138 | 0.126 | 0.012 | 5.8 |
| 0.142 | 0.136 | 0.006 | 4.2 |
| 0.152 | 0.13 | 0.022 | 14.4 |
| 0.144 | 0.146 | 0.002 | 0 |
| 0.188 | 0.15 | 0.04 | 20.2 |
| 0.176 | 0.146 | 0.03 | 17 |
| 0.206 | 0.17 | 0.03 | 17.4 |
| 0.17 | 0.176 | 0 | 0 |
| 0.172 | 0.174 | 0.002 | 0 |
| 0.15 | 0.15 | 0 | 0 |
| 0.152 | 0.15 | 0.02 | 1.3 |
| 0.146 | 0.148 | −0.002 | 0 |
| | | Average = 0.0149 | 7% |

| Time to Impact (Seconds) | | | |
|---|---|---|---|
| Bat 1 | | Grady Bat | |
| Mean | 0.155733333 | Mean | 0.142933333 |
| Standard Error | 0.006040708 | Standard Error | 0.005358986 |
| Median | 0.152 | Median | 0.146 |
| Mode | 0.152 | Mode | 0.15 |
| Standard Deviation | 0.023395563 | Standard Deviation | 0.020755263 |
| Sample Variance | 0.000547352 | Sample Variance | 0.000430781 |
| Kurtosis | 0.205997952 | Kurtosis | −0.779842846 |
| Skewness | 0.52221222 | Skewness | 0.040754392 |
| Range | 0.086 | Range | 0.066 |
| Minimum | 0.12 | Minimum | 0.11 |
| Maximum | 0.206 | Maximum | 0.176 |
| Sum | 2.336 | Sum | 2.144 |
| Count | 15 | Count | 15 |
| Confidence Level (95.0%) | 0.012956031 | Confidence Level (95.0%) | 0.011493882 |

| | Variable 1 | Variable 2 |
|---|---|---|
| Mean | 0.15573333 | 0.142933333 |
| Variance | 0.00054735 | 0.000430781 |
| Observations | 15 | 15 |
| Hypothesized Mean Difference | 0 | |
| Df | 28 | |
| t Stat | 1.58509965 | |
| P(T <= t) one-tail | 0.0620872 | |
| t Critical one-tail | 1.70113093 | |
| P(T <= t) two-tail | 0.12417439 | |
| t Critical two-tail | 2.04840714 | |

| Hand Speed (Miles/Hr) | | | |
|---|---|---|---|
| Bat 1 | Grady Bat | Difference | Percent improvement |
| 34 | 40 | 6 | 15 |
| 34 | 39 | 5 | 13 |
| 34 | 38 | 4 | 11 |
| 29 | 32 | 3 | 9 |
| 28 | 30 | 2 | 7 |
| 27 | 32 | 5 | 16 |
| 20 | 24 | 4 | 17 |
| 21 | 25 | 4 | 16 |
| 22 | 25 | 3 | 12 |

-continued

| | | | |
|---|---|---|---|
| 21 | 27 | 6 | 22 |
| 24 | 26 | 2 | 8 |
| 23 | 25 | 2 | 8 |
| 25 | 27 | 2 | 7 |
| 25 | 28 | 3 | 11 |
| 25 | 27 | 2 | 7 |
| | | Average = 4 MPH | 12% |

Descriptive Statistics and t-test
Hand Speed (Miles/Hr)

| Bat 1 | | Grady Bat | |
|---|---|---|---|
| Mean | 26.13333333 | Mean | 29.66667 |
| Standard Error | 1.241606742 | Standard Error | 1.39614 |
| Median | 25 | Median | 27 |
| Mode | 34 | Mode | 25 |
| Standard Deviation | 4.808722234 | Standard Deviation | 5.407226 |
| Sample Variance | 23.12380952 | Sample Variance | 29.2381 |
| Kurtosis | −0.7302.89987 | Kurtosis | −0.34144 |
| Skewness | 0.648151101 | Skewness | 1.002422 |
| Range | 14 | Range | 16 |
| Minimum | 20 | Minimum | 24 |
| Maximum | 34 | Maximum | 40 |
| Sum | 392 | Sum | 445 |
| Count | 15 | Count | 15 |
| Confidence Level(95.0%) | 2.662981612 | Confidence Level(95.0%) | 2.994422 |

t-Test: Two-Sample Assuming Unequal Variances

| | Variable 1 | Variable 2 |
|---|---|---|
| Mean | 26.13333333 | 29.66667 |
| Variance | 23.12380952 | 29.2381 |
| Observations | 15 | 15 |
| Hypothesized Mean Differ | 0 | |
| df | 28 | |
| t Stat | −1.891134954 | |
| P(T <= t) one-tail | 0.034497046 | |
| t Critical one-tail | 1.701130934 | |
| P(T <= t) two-tail | 0.068994092 | |
| t Critical two-tail | 2.048407142 | |

Bat Speed (Miles/HR)

| Bat 1 | Grady Bat | Difference | Percent Improvement |
|---|---|---|---|
| 87 | 93 | 6 | 7 |
| 83 | 91 | 8 | 9 |
| 78 | 92 | 14 | 15 |
| 73 | 85 | 12 | 14 |
| 84 | 84 | 0 | 0 |
| 76 | 86 | 10 | 12 |
| 53 | 66 | 13 | 20 |
| 64 | 70 | 6 | 9 |
| 54 | 65 | 1 | 2 |
| 67 | 66 | 0 | 0 |
| 59 | 68 | 9 | 13.2 |
| 54 | 66 | 2 | 3 |
| 67 | 76 | 9 | 12 |
| 69 | 78 | 9 | 12 |
| 70 | 72 | 2 | 3 |
| | | Avg = 7 MPH | 9% |

Descriptive Statistics and t-test:
Bat Speed (Miles/Hr)

| Bat 1 | | Grady Bat | |
|---|---|---|---|
| Mean | 70.533333 | Mean | 77.2 |
| Standard Error | 2.4839804 | Standard Error | 2.703085 |
| Median | 69 | Median | 76 |
| Mode | 64 | Mode | 66 |
| Standard Deviation | 9.6204148 | Standard Deviation | 10.469 |
| Sample Variance | 92.552381 | Sample Variance | 109.6 |
| Kurtosis | −0.5288653 | Kurtosis | −1.58878 |
| Skewness | 0.1468563 | Skewness | 0.284463 |
| Range | 34 | Range | 28 |

-continued

| | | | |
|---|---|---|---|
| Minimum | 53 | Minimum | 65 |
| Maximum | 87 | Maximum | 93 |
| Sum | 1058 | Sum | 1158 |
| Count | 15 | Count | 15 |
| Confidence Level(95.0%) | 5.3276081 | Confidence Level(95.0%) | 5.79754 |

t-Test: Two-Sample Assuming Unequal Variances

| | Variable 1 | Variable 2 |
|---|---|---|
| Mean | 70.533333 | 77.2 |
| Variance | 92.552381 | 109.6 |
| Observations | 15 | 15 |
| Hypothesized Mean Differ | 0 | |
| df | 28 | |
| t Stat | −1.8159962 | |
| P(T <= t) one-tail | 0.0400468 | |
| t Critical one-tail | 1.7011309 | |
| P(T <= t) two-tail | 0.0800937 | |
| t Critical two-tail | 2.0484071 | |

Results:

Bat 2 resulted in a mean 7 mile/hr. (9.0%) increase in bat velocity, a mean increase of 4 mile/hr. (12%) in hand speed, and a mean decrease of 0.014 seconds (7%) in time to impact.

According to Zepp Labs information, a 1.0 mile/hr. increase in bat velocity equates to increased distance of a hit baseball by 5 feet. Therefore, the Grady Bat may produce increased distance for hit baseballs by an average of 35 feet.

The description above focused on the device 20 in use with a bat. It is to be understood that the device 20 may be used with a variety of different equipment that are each configured to be swung by a user and which generate turning forces during use of the tool. Examples of equipment include but are not limited to golf clubs, tennis racquets, hammers, pickaxes, and sledgehammers.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of using a flange device with equipment to improve a user's swing of the equipment, the method comprising:

grasping a handle of the equipment between the flange device and a distal end of the handle, the flange device being attached to the handle and extending completely around the handle with a perimeter wall of the flange device being radially spaced outward from the handle and with a first side of the flange device facing towards the distal end of the handle and an opposing second side facing in an opposing direction;

contacting the first side of the flange device while grasping the handle;

aligning an indent in the flange device with an injury-prone section of the user's lower hand, the indent extending into the first side and the perimeter wall and being positioned at an intersection of the first side and the perimeter wall, the injury-prone section comprising triquetral and pisiform bones region;

swinging the equipment while grasping the handle and maintaining contact with the first side and of the flange device and with the injury-prone section remaining aligned with the indent.

2. The method of claim 1, wherein a first side of the flange device comprises a cushion layer and contacting the first side of the flange device comprising contacting the cushion layer.

3. The method of claim 1, further comprising swinging the equipment and forcing air to travel through holes in the flange device that extend between the first and second sides, the holes being spaced around the periphery of the flange device and being closer to the perimeter wall than to a center of the flanged device.

4. The method of claim 3, further comprising moving the air through a section of the holes that has a reduced cross-sectional area and that is positioned along a length of the holes in proximity to the first side of the flange device.

5. The method of claim 1, further comprising sliding the handle through a central opening in the flange device and adjusting a position of the flange device along the handle of the equipment.

6. The method of claim 5, further comprising contacting the second side of the flange device against an enlarged knob at a proximal end of the handle, the enlarged knob having a length that is less than the flange device and greater than the handle with the lengths measured in a plane perpendicular to a midline of the handle.

7. The method of claim 1, further comprising removing the flange body from the handle by pivoting apart first and second sections of the flange body that are connected together at a pivot.

8. The method of claim 7, further comprising attaching the flange body to the handle of the equipment by positioning ends of each of the first and second sections into an overlapping arrangement.

9. A method of using a flange device with equipment to improve a user's swing of the equipment, the method comprising:

grasping a handle of the equipment and contacting a top side of the flange device that is attached to the handle, the flange device extending circumferentially around the handle at a knob at a proximal end of the handle of the equipment, the flange device including a greater length than the handle and the knob with the length measured across the flange device in a plane perpendicular to a midline of the handle;

aligning an indent positioned within the top side of the flange device with the hamate and triquetral bone regions of the user, the indent positioned at an intersection of the top side and a perimeter wall of the flange device and extending into the top side and the perimeter wall; and swinging the equipment while grasping the handle and maintaining contact with the top side of the flange device.

10. The method of claim 9, further comprising contacting the top side of the flange device continuously around the circumference of the handle.

11. The method of claim 9, wherein the top side of the flange device comprises a cushion layer and contacting the first side of the flange device comprises contacting the cushion layer.

12. The method of claim 9, further comprising swinging the equipment and forcing air to travel through holes that extend through the flange device.

13. The method of claim 9, further comprising sliding the handle through a central opening in the flange device and adjusting a position of the flange device along the handle of the equipment.

14. The method of claim 9, further comprising moving a rounded projection on a proximal end of the handle with the equipment, the rounded projection including a first side that faces the handle that is flat and a second side that includes a rounded shape.

15. A device for positioning along a handle of a piece of swinging equipment with the equipment including a first end with the handle and a second working end, the device comprising:

a body with a contact side configured to be positioned towards the second working end, an opposing second side, and a perimeter wall that extends between the first and second sides, the body including a central opening sized to receive the handle and extending completely around the central opening, the body having a length that is greater than the handle with the length measured in a plane perpendicular to a midline of the handle;

the contact side of the body being flat; and an indent positioned at an intersection of the first side and the perimeter wall and extending into the first side and the perimeter wall.

16. The device of claim 15, wherein the second side of the body is flat and the body includes a constant thickness measured between the contact side and the second side.

17. The device of claim 15, further comprising holes that extend through the body with openings at each of the second side and the contact side, the holes being spaced apart around the periphery of the body and being closer to the perimeter wall than to the central opening.

18. The device of claim 15, wherein the body is a constructed as a single piece.

19. The device of claim 15, wherein the body is constructed from first and second sections that are connected together at a pivot, each of the first and second sections includes a first end in proximity to the pivot and an opposing second end, the body being movable between an open orientation with the second ends being spaced apart and a closed orientation with the second ends that enclose the central opening.

* * * * *